US007703757B2

(12) United States Patent
Watanabe et al.

(10) Patent No.: US 7,703,757 B2
(45) Date of Patent: Apr. 27, 2010

(54) SHEET PROCESSING APPARATUS

(75) Inventors: Kiyoshi Watanabe, Matsudo (JP); Kenichi Hayashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 37 days.

(21) Appl. No.: 12/019,179

(22) Filed: Jan. 24, 2008

(65) Prior Publication Data

US 2008/0179810 A1 Jul. 31, 2008

(30) Foreign Application Priority Data

Jan. 31, 2007 (JP) ..... 2007-021282

(51) Int. Cl.

| | |
|---|---|
| ***B41L 43/00*** | (2006.01) |
| ***B41L 1/32*** | (2006.01) |
| ***B65H 39/02*** | (2006.01) |
| ***B65H 39/00*** | (2006.01) |

(52) U.S. Cl. ..... 270/32; 270/39.01; 270/58.07; 270/58.12; 270/58.27

(58) Field of Classification Search ..... 270/58.08, 270/58.07, 58.01; 412/35

See application file for complete search history.

(56) References Cited

U.S. PATENT DOCUMENTS

| | | | | |
|---|---|---|---|---|
| 5,897,250 | A | 4/1999 | Hirai et al. | 399/404 |
| 6,241,234 | B1 | 6/2001 | Saitoh et al. | 270/58.12 |
| 6,290,220 | B1 | 9/2001 | Takehara et al. | 270/58.12 |
| 6,832,066 | B2 | 12/2004 | Watanabe et al. | 399/299 |
| 7,099,616 | B2 | 8/2006 | Kato et al. | 399/328 |
| 7,107,000 | B2 | 9/2006 | Watanabe et al. | 399/328 |
| 2004/0071529 | A1 * | 4/2004 | Kawatsu et al. | 412/35 |
| 2007/0057434 | A1 * | 3/2007 | Nakamura et al. | 271/109 |

FOREIGN PATENT DOCUMENTS

| | | |
|---|---|---|
| JP | 2000-198613 | 7/2000 |
| JP | 2000198613 A * | 7/2000 |

* cited by examiner

*Primary Examiner*—Gene Crawford
*Assistant Examiner*—Yolanda Cumbess
(74) *Attorney, Agent, or Firm*—Fitzpatrick, Cella, Harper & Scinto

(57) ABSTRACT

A conveying apparatus includes a regulating portion which regulates the opening of the folded sheet bundle, and a conveying portion which pushes the sheet bundle from an upstream side in a conveying direction in a state that the regulating portion regulates the opening of folded sheet bundle.

10 Claims, 15 Drawing Sheets

SHEET PROCESSING APPARATUS

BACKGROUND OF THE INVENTION

1. Field of the Invention

The present invention relates to a sheet processing apparatus which processes bundled and folded sheets.

2. Description of the Related Art

A toner image is formed on a sheet at an image forming portion and then the toner image-formed sheet is processed. In such a sheet processing apparatus, a process of binding a bundle of sheets, for example, at near the center of the conveying direction with staples and folding it in half from the bound part to have a booklet shape and discharging it, a so-called saddle stitch binding operation, has been widely performed. Further, various methods which improve the appearance and quality of the booklet by evenly cutting the edges of the bundle of the sheets folded in half with a cutting apparatus and performing trimming have been proposed (refer to Japanese Patent Application Laid-Open (JP-A) No. 2000-198613).

Incidentally, there are the following problems to be solved in the conventional sheet post-processing apparatus including a sheet cutting method and a sheet cutting apparatus, described in JP-A No. 2000-198613. They will be briefly described with reference to FIGS. 15A to 15E.

An operational sequence in which a plurality of sheets is bundled and bound with staples in the central part along the conveying direction and then the edges of the sheet bundle T folded in half and discharged are cut, which are subjected to trimming will be illustrated with reference to FIGS. 15 (*a*) to (e).

At the stage before the sheet bundle T is conveyed to a trimmer, a width direction of the sheet bundle folded in half is regulated by side guides during the conveyance to reach the trimmer and the skew feeding is corrected. The sheet bundle is carried on conveying belts, which rotate to convey the bundle.

At this point, it is necessary to enhance a poor crease line of the sheet bundle T by pressing the crease with pressing members so that a space between the edges of the sheet bundle is not opened. This is because the space between the edges is opened as shown in FIG. 15B even when it is folded in half as shown in FIG. 15A. However, smooth conveyance of the sheet bundle T is interrupted by the resistance of the pressing force exerted by pressing guides. In some cases, the sheet bundle may not be conveyed. Further, when a color image is recorded on the top of the sheet bundle T, or alternatively smooth-coated paper or a thin paper sheet is used, the coefficient of friction between the conveying belts and the front cover of the sheet bundle T is low. Therefore, the sheet bundle T sometimes will not be conveyed due to its sliding. In order to support such a conveyance, a structure in which a claw-shaped pushing member that operates at the same speed as the running speed of the conveying belts pushes the rear end of the sheet bundle T from behind is also proposed.

However, because the claw-shaped pushing member operates at the same speed as the running speed of the conveying belts, the claw-shaped pushing member cannot surely push the rear end of the sheet bundle. Therefore even if it has such a pressing structure, only the front cover sheet of the sheet bundle T may be advanced due to the contact friction with the conveying belts as illustrated in FIG. 15C.

If the edges of the sheet bundle is cut in the state that the top of the front cover sheet of the sheet bundle T is advanced, the edges of the front cover sheet are protruded from the edges of the middle sheet as illustrated in a circle in FIG. 15D, resulting in a booklet with very bad appearance. As illustrated in FIG. 15E, it is desired that the edges of the sheet bundle T having a booklet shape are cut finely and evenly.

As an example of the problems, the problem that the edges of the front cover sheet of the sheet bundle after cutting are not evenly aligned with the edges of other sheets and they are protruded from the edges of the sheet bundle is listed. However, as illustrated in FIG. 15C, when the booklet is not subjected to the cutting process, its cover sheet is misaligned, which looks bad. Further, in the case where the sheet bundle is bound at the folded portion, as illustrated in FIG. 15C, when only the top of the front cover sheet is advanced, a large load acts on the bound portion with staples of the front cover sheet. At the part close to the bound portion with staples, breakage in which the front cover sheet is torn may occur.

When the sheet bundle is conveyed by the belts, the state of the sheet bundle becomes like that of FIG. 15C. This misalignment becomes significant in the case where the contact friction between the surface of the conveying belts and the front cover sheet of the sheet bundle is larger than the coefficient of friction of the inner surface of the front cover sheet and the middle sheet. That is, for example, in the case where a monochrome image is recorded on the front cover sheet and a color image is recorded on the inner surface of the front cover sheet and the middle sheet, respectively, the failure in which only the front cover sheet is advanced frequently occurs.

SUMMARY OF THE INVENTION

The present invention is directed to a sheet processing apparatus which can convey a bundle of folded sheets without misalignment of the bundle.

According to the present invention, there is provided a sheet processing apparatus which includes a regulating portion configured to regulate an opening of the sheet bundle, and conveying portion configured to convey the folded sheet bundle by pushing the folded sheet bundle from an upstream side in the conveying direction in a state that the opening of the folded sheet bundle is regulated by the regulating portion.

According to the sheet processing apparatus of the present invention, when the bundle of the sheets is conveyed while the opening of the folded sheet bundle is regulating by the regulating portion, the misalignment is reduced.

Further features of the present invention will become apparent from the following description of exemplary embodiments (with reference to the attached drawings).

DESCRIPTION OF THE EMBODIMENTS

Hereinbelow, an exemplary embodiment of the sheet post-processing apparatus according to the present invention will be specifically described with reference to drawings.

Figure 1:
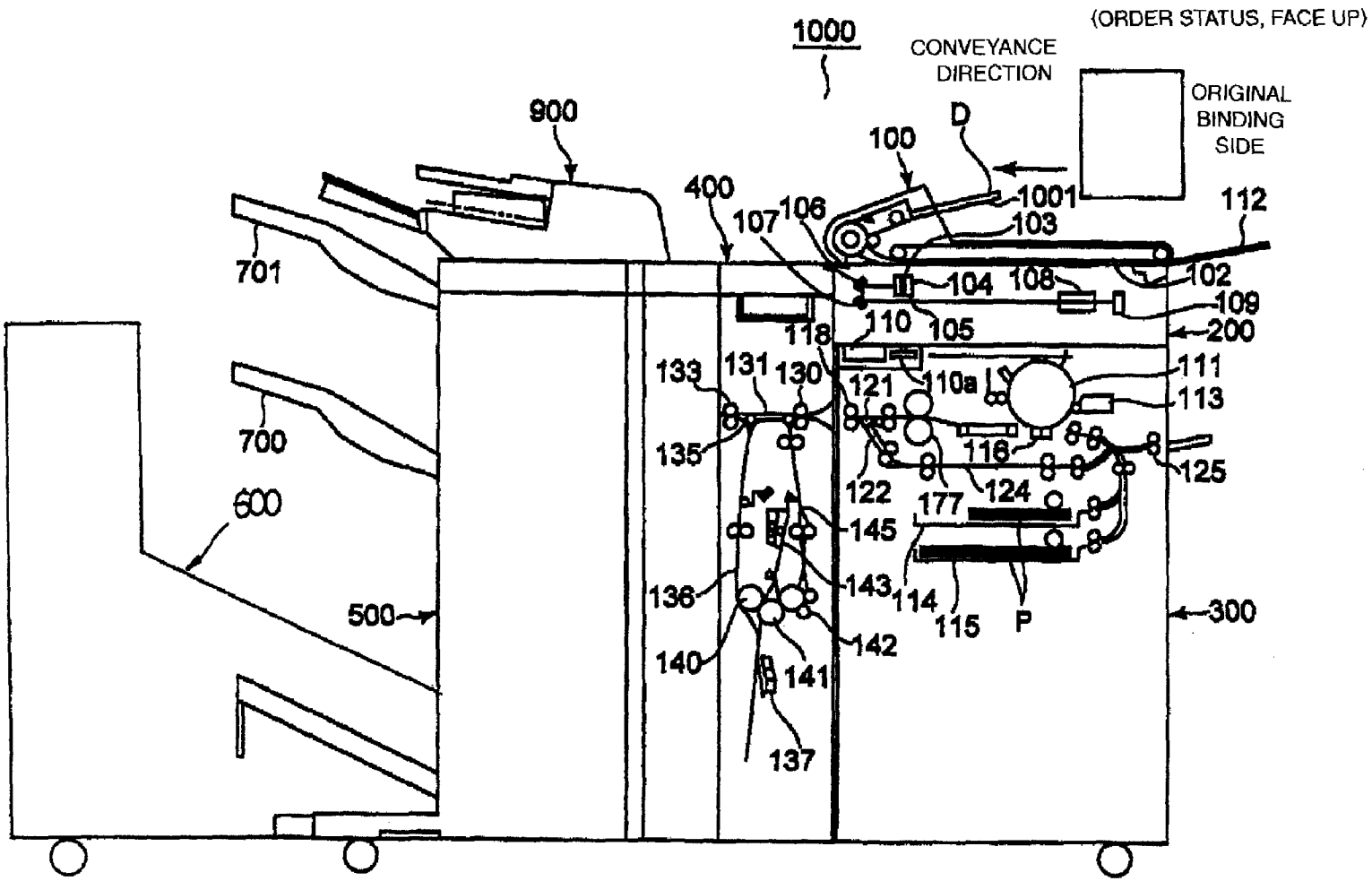
FIG. 1 illustrates a copy machine with which a sheet post-processing apparatus of an embodiment according to the present invention is equipped as an example of an image forming apparatus.

FIG. 1 illustrates a copy machine 1000 as an illustrative example of the image forming apparatus with which the sheet post-processing apparatus of the embodiment is equipped. The copy machine 1000 includes an original feeding portion 100, an image reader portion 200, a printer portion 300, a fold processing portion 400, a finisher 500, a trimmer unit 600, a saddle stitch binding unit 800, and an inserter 900. It should be noted that the fold processing portion 400, the saddle stitch binding unit 800, and the inserter 900 can be retrofitted to the copy machine as an optional extra. The sheet post-processing apparatus consists of the fold processing portion 400, the finisher 500, the trimmer unit 600, the saddle stitch binding unit 800, and the inserter 900.

Figure 7:
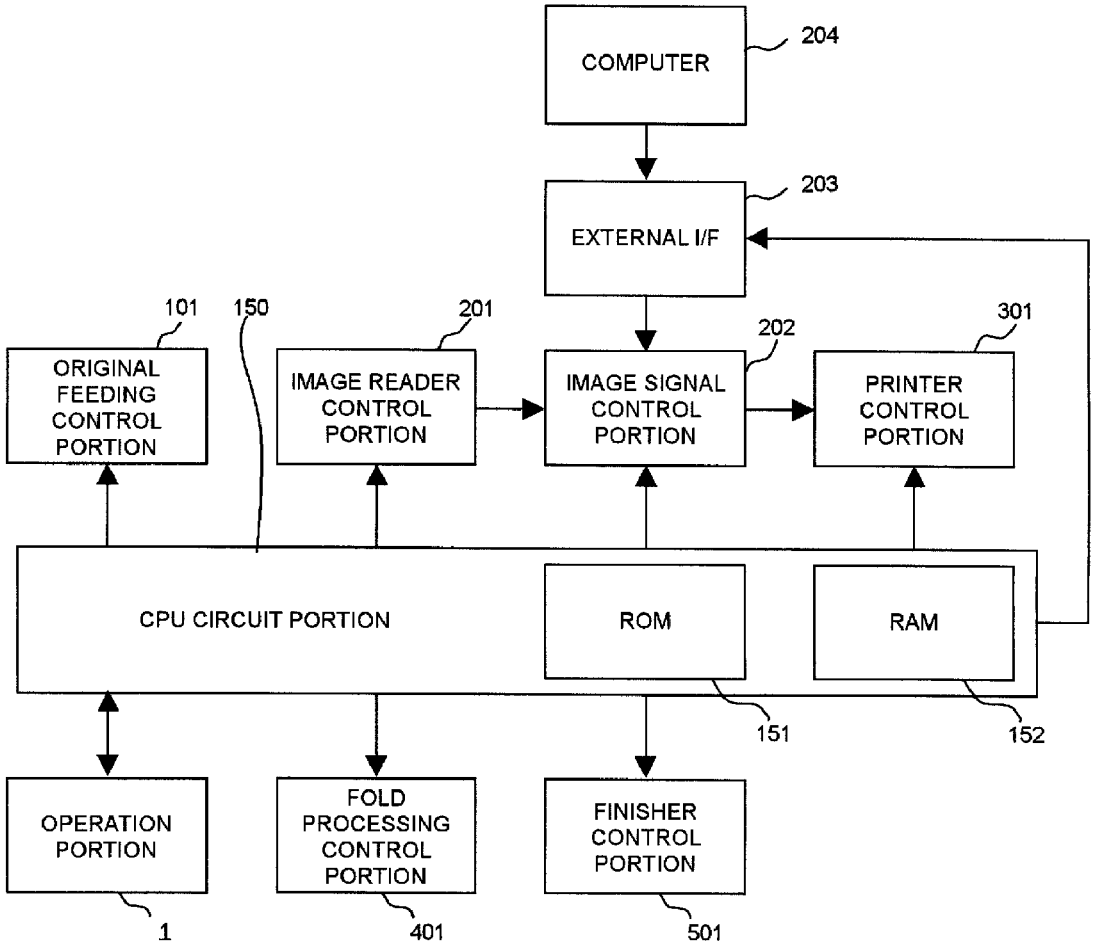
FIG. 7 is a functional block diagram illustrating a control system structure of a copy machine which includes the sheet post-processing apparatus of the embodiment.

In the functional block diagram of FIG. 7, a CPU circuit portion 150 has CPU 150A (central processing unit). The CPU circuit portion 150 controls over each of the portions of the copy machine based on a control program stored in ROM 151 and a setting of an operation portion 1. That is, the CPU circuit portion 150 controls an original feeding control portion 101, an image reader control portion 201, an image signal control portion 202, a printer control portion 301, a fold processing control portion 401, a finisher control portion 501, and an external I/F 203, respectively. The original feeding control portion 101 controls the original feeding portion 100. The image reader control portion 201 controls the image reader portion 200. The printer control portion 301 controls the printer portion 300. The fold processing control portion 401 controls the fold processing portion 400. The finisher control portion 501 controls the finisher 500, the trimmer unit 600, the saddle stitch binding unit 800, and the inserter 900. The operation portion 1 has a plurality of keys for setting up various functions of image formation and a display portion for indicating the settings. The operation portion 1 outputs a key signal corresponding to the operation of each key by a user to the CPU circuit portion 150 and displays the information corresponding to the signal from the CPU circuit portion 150 on the display portion.

A RAM 152 is used as an area for temporarily holding the control data and a working area of a calculation in association with the controlling operation. The external I/F 203 is an interface between the copy machine 1000 and an external computer 204. The external I/F 203 expands the print data from the computer 204 into a bit map image and outputs it to the image signal control portion 202 as image data. In addition, the image of the original read by the image reader portion 200 is output from the image reader control portion 201 to the image signal control portion 202. The printer control portion 301 outputs the image data from the image signal control portion 202 to an exposure controlling portion (not illustrated). The structure and operation of each of the portions are as follows.

The original is set on a tray 1001 of the original feeding portion 100 with the surface where the image information is recorded face up (in an order position for reading as seen from the user). FIG. 1 illustrates that the binding position of the original is set to the left end. The original set on the tray 1001 is fed one by one from the head page in the state that the original binding position, which is the left-hand position (illustrated by an arrow in FIG. 1), is set to the head position.

A scanner unit 104 reads the image information of the original passing through the curved feeding path, moving on the platen glass 102 from left to right, and passing on the scanner unit 104. Such a method of reading the original while feeding it is sometimes called "skimming". In other words, when the original is passing through on the platen glass 102, the reading surface of the passing original is irradiated with a lamp 103 of the scanner unit 104. The reflected light from the original is introduced to an image sensor 109 through mirrors 105, 106, 107, and a lens 108. The original thus skimmed is discharged to a catch tray 112.

As an alternative way of the reading method of skimming the original, an image of the original can also be read by a method of reading the original which is stationary on the platen glass 102, the so-called "stationary reading". In that case, the original fed from the original feeding portion 100 is temporarily stopped on the platen glass 102 so as to be stationary and then the scanner unit 104 moves against the original from left to right (see FIG. 1) to read the image information of the original.

In the case of reading the original without using the original feeding portion 100, the user opens the original feeding portion 100 to set the original on the platen glass 102 and then closes the original feeding portion 100 to hold the original. With the original held, the scanner unit 104 is moved to read the image information of the original. That is, in this case, the original is statically read in the same manner as described above.

The image data of the original which is thus read by the image sensor 109 using any of the reading methods is transmitted to an exposure control portion 110. The exposure control portion 110 outputs a laser beam depending on an image signal. The photoconductive drum 111 which includes an image bearing member of the image forming portion is irradiated with the laser beam while scanning with a polygonal mirror 110*a*. Then, an electrostatic latent image depending on the scanned laser beam is formed on the photoconductive drum 111. The electrostatic latent image formed on the photoconductive drum 111 is developed by a development device 113 so as to be visualized as a toner image.

The toner image is transferred to a sheet such as a recording paper which is fed from any one of cassettes 114, 115, a manual paper feeding portion 125, and a sheet re-feeding path 124 at a transfer portion 116. Further, the sheet to which the toner image is transferred is fed to a fixing portion 177, which is then heated and pressurized to fix the toner image permanently. The sheet passed through the fixing portion 177 after the fixing process is temporarily guided by a flapper 121 to be forwarded to the feeding path 122. When the rear end of the sheet runs through the flapper 121, it is detected and the sheet is switchbacked. The sheet is guided to a discharge roller 118 by a path switching of the flapper 121 and it is fed and discharged from the printer portion 300. As described above, the sheet is discharged from the printer portion 300 in the state that the surface having the toner image formed after a series of processes is placed face down.

When the image formation processing is performed by discharging the sheet with its face down toward the exterior of the copy machine in order starting from the head page, or when the image formation processing is carried out using the original feeding portion 100, the pages can be arranged in correct order. Further, the pages can be arranged in correct order when the image data transmitted from a higher-level device such as a personal computer is subjected to the image formation processing.

Although the image formation processing of the duplex sheet is not herein described in detail, it involves guiding the sheet from the fixing portion 177 to the direction of the discharge roller 118, switchbacking the sheet immediately after the rear end of the sheet runs through the flapper 121, and guiding it to the sheet re-feeding path 124 by the flapper 121.

<Fold Processing Portion>

Next, the structure of the fold processing portion 400 will be described with reference to FIG. 1.

The fold processing portion 400 has a feeding path 131 which introduces the sheet discharged from the printer portion 300 and guides it to the finisher 500 for the next step. Several sets of opposed pairs, for example, conveying rollers 130 and 133 are placed on the feeding path 131, respectively. A switching flapper 135 disposed in the vicinity of the conveying roller 133 switches the operation so as to guide the sheet conveyed by the conveying roller 130 to either a folding path 136 or the finisher 500.

In the case of carrying out the folding process of the sheet, the switching flapper 135 guides the sheet to the folding path 136 so as to be switched to the side of the folding path 136. The sheet guided to the folding path 136 is conveyed to folding rollers 140 to 142 to be folded down into a Z-shape. When the folding process is not performed, the switching flapper 135 is switched to the side to guide the sheet to the finisher 500. Then, the sheet discharged from the printer portion 300 passes through the feeding path 131 and is directly fed to the finisher 500.

The sheet conveyed to the folding path 136 is folded down by the folding rollers 140 and 141 after a loop is formed with its leading edge abutted against a stopper 137. The sheet is folded down in the Z-shape by folding down the loop formed by abutting this folded part against an upper stopper 143 and further folding down it by the rollers 141 and 142. The sheet folded down in the Z-shape is guided to the feeding path 131 via a feeding path 145 and then is discharged towards the finisher 500 located at the downstream side by a discharge roller 133.

<Finisher>

Next, the structure and operation of the finisher 500 will be described with reference to FIGS. 1 and 2. The movement of each portion of the finisher 500 is controlled by the finisher control portion 501.

The finisher 500 carries out the processing of the sheet, for example, the processing to form a sheet bundle by aligning a plurality of the sheets conveyed from the printer portion 300 via the fold processing portion 400. In addition, the finisher 500 performs the binding process for binding the rear end side of the sheet bundle with staples, and further performs the sort processing, the non-sort processing, or the like.

Figure 2:
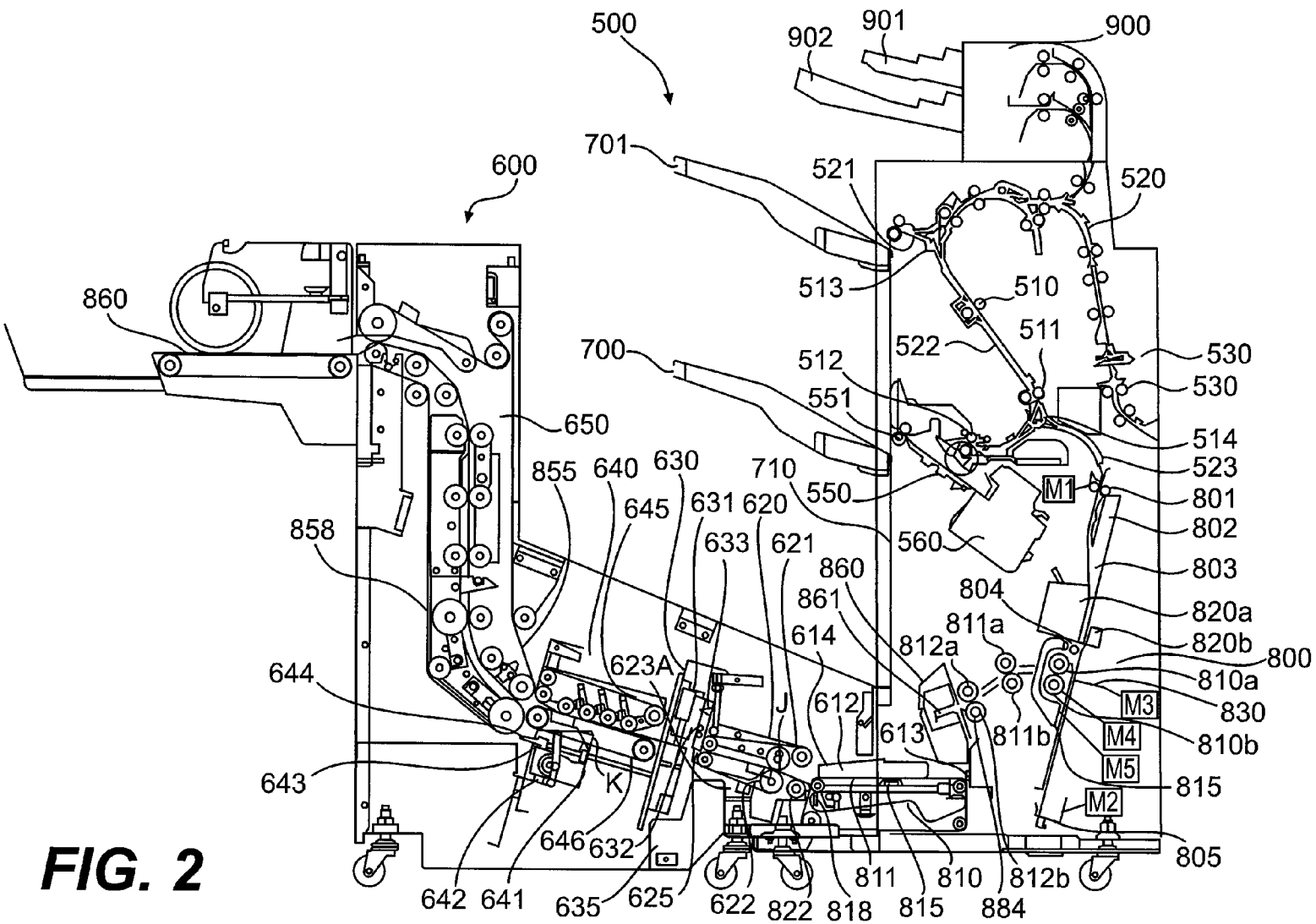
FIG. 2 illustrates the sheet post-processing apparatus to which the embodiment is applied.

As shown in FIG. 2, the finisher 500 has a feeding path 520 for taking the sheet conveyed via the fold processing portion 400 into the inside of the finisher and the feeding path 520 is formed with a plurality of conveying rollers. A punch unit 530 is disposed on the way of the feeding path 520. The punch unit 530 serves to bore a hole in, or otherwise perform the perforating operation at, the rear end portion of the sheet as necessary. Further, conveying roller pairs 502 to 508 are disposed in the order from an entrance-side roller 501 to the downstream side of the sheet conveying direction. The punch unit 530 is disposed between the conveying roller 502 and the conveying roller 503. The punch unit 530 serves to perform the perforating operation at the rear end portion of the sheet to be fed by carrying out the operation as necessary.

A flapper 513 disposed at the terminal end of the feeding path 520 serves to selectively switch the path between an upper paper discharge path 521 and a lower paper discharge path 522 that are fastened to the downstream side thereof. The upper paper discharge path 521 discharges the sheet to a sample tray 701 by an upper discharge roller 509. On the other hand, the lower paper discharge path 522 is formed with conveying roller pairs 510, 511, and 512. These conveying rollers convey the sheet to a processing tray 550 and discharge it. The sheets discharged to the processing tray 550 are stacked into a bundle being aligned sequentially, and the sort processing and the staple processing are carried out depending on the setting by the operation portion 1. Then, the processed sheet is discharged to a stack tray 700 by a bundle discharge roller pair 551.

Here, the staple processing is carried out by a stapler 560. The stapler 560 staples the arbitrary part of the sheet bundle in a width direction of the sheet bundle, i.e. in a direction perpendicular to the sheet conveying direction. The stack tray 700 and the sample tray 701 can move up and down along the finisher 500. The upper sample tray 701 receives the sheet conveyed from the upper paper discharge path 521 and the processing tray 550. The lower stack tray 700 serves to receive the sheet conveyed from the processing tray 550. Thus, large amounts of sheets are stacked on the stack tray 700 and the sample tray 701. The stacked sheets are aligned with rear ends thereof received by a rear end guide 710 elongated vertically.

<Saddle Stitch Binding Unit>

Next, the structure and operation of the saddle stitch binding unit 800 which is included in the finisher 500 will be described with reference to FIG. 2.

The saddle stitch binding unit 800 has an opposed pair of press rollers 861. A switching flapper 514 disposed on the way of the lower paper discharge path 522 switches the sheet into the right side to guide the sheet to a saddle paper discharge path 523 and to the saddle stitch binding unit 800. The sheet is transferred to an opposed pair of saddle inlet rollers 801 and is fed into a storage guide 803 of the saddle stitch binding unit 800 while an inlet is selected by a flapper 802 operated by a solenoid depending on the size. Then, the sheet thus fed into the storage guide 803 is conveyed to the position where the leading edge of the sheet is brought into contact with a sheet positioning member 805 having an edge movable by a slide roller 804. The saddle inlet roller 801 and the slide roller 804 are driven by a motor M1. Further, on the way of the storage guide 803, a stapler 820 is formed at the position across the storage guide 803. The stapler 820 has a driver 802*a* for projecting staples and an anvil 802*b* for folding the projected staples, which bind the bundle sheet with staples.

Here, in the conveyance of the sheet, the sheet positioning member 805 can be located at a position where the middle portion of the sheet in the sheet conveying direction becomes a binding position of the stapler 820. The sheet positioning member 805 can be moved by a rotating force of a motor M2 and is capable of changing positions according to the size of the sheet.

At the downstream side of the stapler 820, there are provided a pair of folding rollers 810*a* and 810*b* and a thrust member 830 is formed at a position opposed to the pair of folding rollers 810*a* and 810*b*. The thrust member 830 has a home position which is set at a position behind the storage guide 803 and thrusts toward the stored sheet bundle by being driven by a motor M3. Thus, pushing the sheet bundle to a nip between the pair of folding rollers 810*a* and 810*b* enables it to be folded. Thereafter, the thrust member 830 moves back and then returns to the home position.

In this regard, a spring member is hooked on a shaft between the folding rollers 810*a* and 810*b* so that a pressure required and sufficient for creasing the sheet bundle is applied thereto. The sheet bundle folded down is discharged on a first folding conveying roller 811 described later by an opposed pair of first folding conveying rollers 811*a* and 811*b*, and an opposed pair of second folding conveying rollers 812*a* and 812*b*. The required and sufficient forces F2 and F3 to convey or stop the folded sheet bundle are added between the first folding conveying rollers 811 and between the second folding conveying rollers 812. A pair of the folding rollers 810*a* and 810*b* as well as the first folding conveying roller 811 and the second folding conveying roller (a discharge unit) 812 are uniformly rotated by a common motor.

Further, when the sheet bundle bound by the stapler 820 is folded in half from the bound portion with staples, the sheet positioning member 805 is moved downward only a distance necessary to fit the bound portion to the nip of the folding roller 810. The portion stapled by moving the member downward is set as a base point and the sheet bundle is folded in half.

An opposed pair of aligning portions 815 has a face protruded to the storage guide 803 rotating around the external circumferential face of the folding rollers 810*a* and 810*b* so as to conduct alignment of the width of the sheets that are stored in the storage guide 803. The aligning portion 815 can move in a direction of sandwiching the sheet by the motor, performs the positioning in a direction of the width of the sheet, and aligns the sheet bundle.

Figure 6:
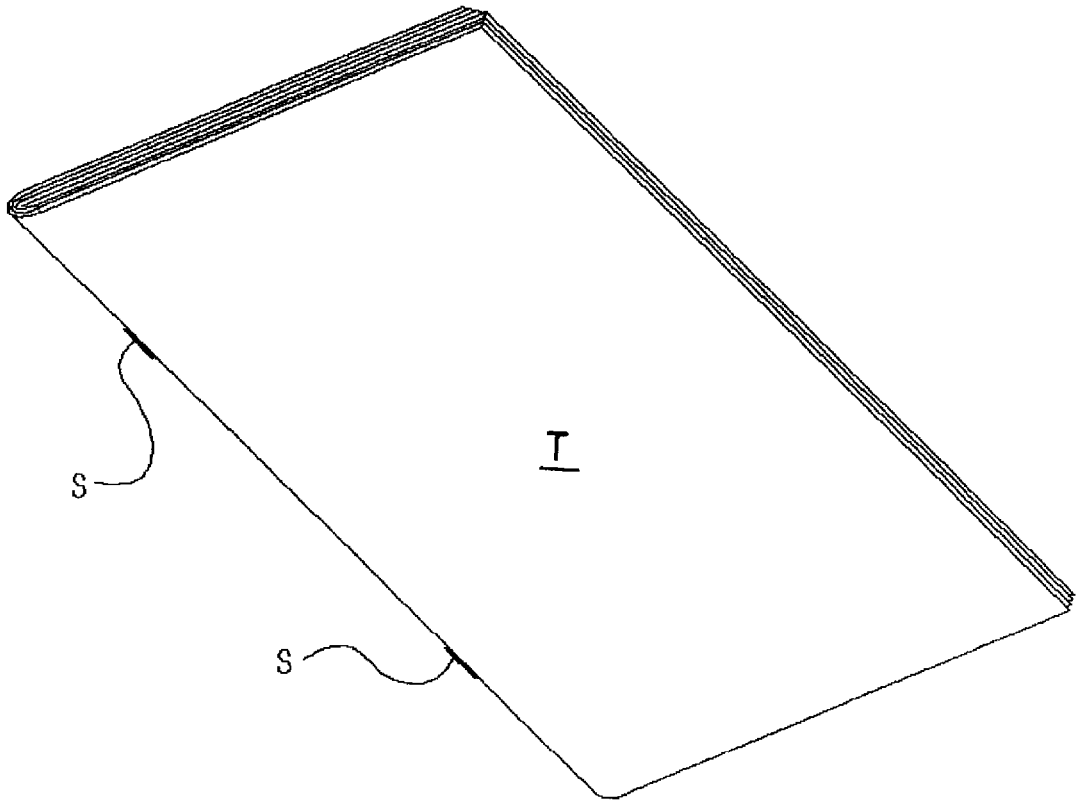
FIG. 6 is a perspective view illustrating a bundle of sheets before cutting.

At the downstream side of the second folding conveying roller 812, a crease pressing unit 860 is disposed. This crease pressing unit 860 enhances the crease by moving in a direction perpendicular to the sheet conveying direction (a direction perpendicular to the drawing) with the crease nipped by the press roller 861. Thus, the sheet bundle T having a booklet shape (illustrated in FIG. 6) can be obtained.

<Trimmer Unit>

Here, the structure and operation of the trimmer unit 600 will be described with reference to FIG. 2. The movement of each portion of the trimmer unit 600 is controlled by the finisher control portion 501 as a control portion.

The trimmer unit 600 includes a receiving and conveying portion 610, a pinch belt conveying portion 620, a cutting portion 630, a cutting and conveying portion 640, a vertical conveying portion 650, and a paper discharge portion 660, which are arranged in order from the upstream side and is also a main portion of the embodiments described below.

The trimmer unit 600 conveys the sheet bundle folded by the first folding conveying roller 811 and the second folding conveying roller 812 of the saddle stitch binding unit 800 via each conveying portion. The trimmer unit 600 conveys the sheet bundle so that the folded portion of the folded sheet bundle should be located at the downstream end (leading edge). A sheet bundle conveying apparatus includes the receiving and conveying portion 610, the pinch belt conveying portion 620, the cutting and conveying portion 640, the vertical conveying portion 650, and the paper discharge portion 660 in the trimmer unit 600.

Figure 3:
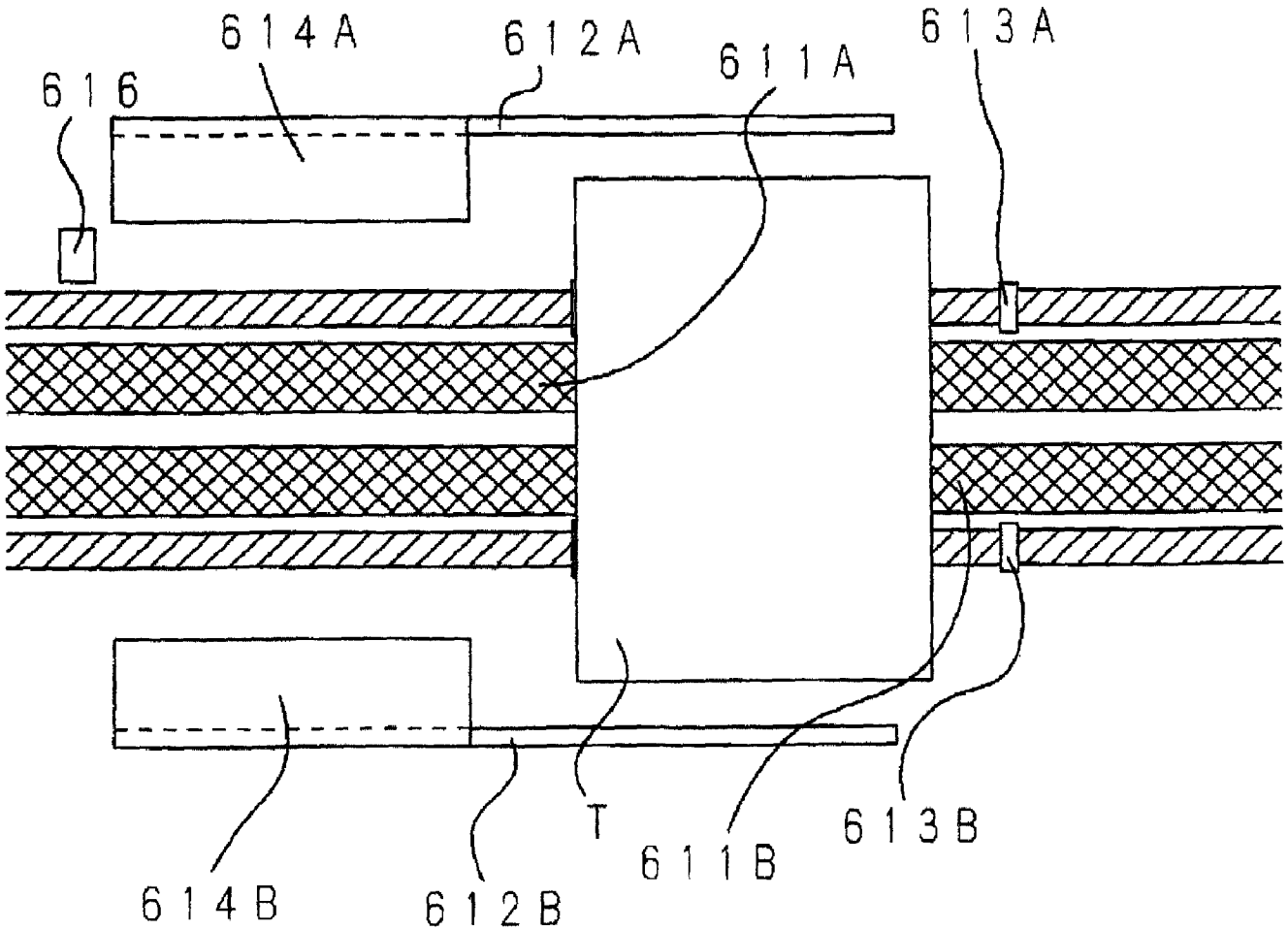
FIG. 3 is a plain view illustrating a receiving and conveying portion in the embodiment.

As illustrated in the plain view of FIG. 3, the receiving and conveying portion 610 has the first conveying belt (supporter conveying portion) 611 only at the lower side in order to receive the sheet bundle T from the saddle stitch binding unit 800. The first conveying belt 611 supports the sheet bundle placed thereon. Side guides (aligning portion) 612A and 612B are formed on both sides of a first conveying belt 611. The side guides 612A and 612B are movable guides that can relatively move in a width direction of the sheet bundle T, and they align the sheet bundle T during conveyance to correct skew feeding. Further, a conveying claw (the conveying portion) 613 illustrated in FIG. 2 is disposed at the both sides of the first conveying belt 611, which can move to the conveying direction of the sheet bundle T and push the rear end of the sheet bundle T from behind to support the conveyance and then transfers the sheet bundle T to the pinch belt conveying portion 620. That is, the conveying claw 613 serves to convey the sheet bundle T as the second conveying portion in such a manner that the conveying claw abuts the rear end of the sheet bundle and pushes it from behind toward the downstream side. The conveying claw 613 is attached to a driving belt and moved by the rotation of the driving belt. The driving belt to which the conveying claw 613 is attached is placed without contacting with the under surface of the sheet bundle. Further, an outlet sensor 616 which detects the sheet bundle T to be conveyed is formed in the receiving and conveying portion 610.

The pinch belt conveying portion 620 has a second upper belt 621 and a second lower belt 622 and sandwiches the sheet bundle received from the receiving and conveying portion 610 between the second upper belt 621 and the second lower belt 622 to convey.

As illustrated in FIG. 2, a nip J which sandwiches the sheet bundle T between the opposed belts is formed in the pinch belt conveying portion 620 and at its downstream side, an inlet sensor (second sheet bundle detecting portion) 623A of the pinch belt conveying portion 620 is disposed. The inlet sensor 623A detects that the sheet bundle T reached to the pinch belt conveying portion 620 is transferred.

Figure 4:
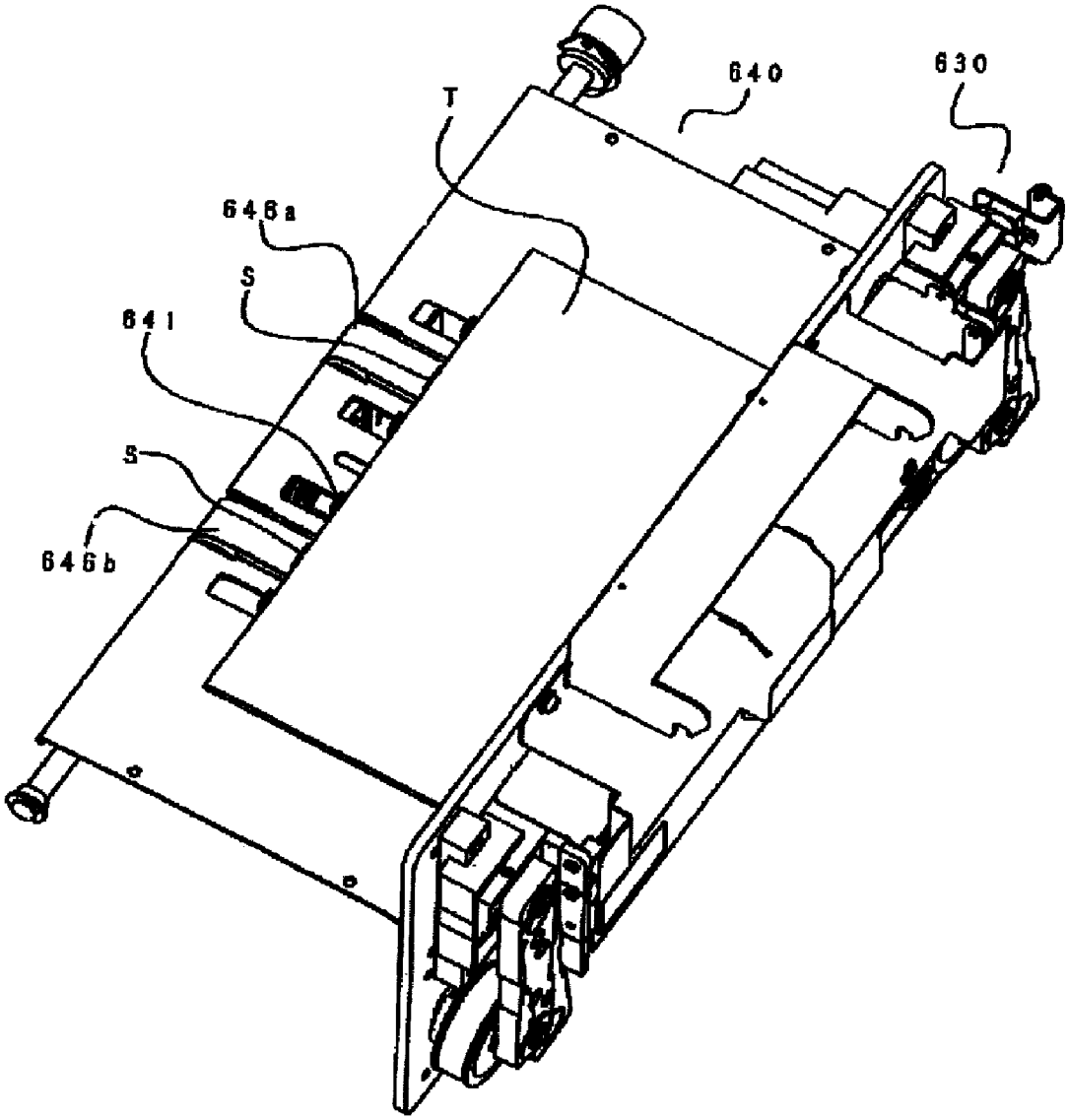
FIG. 4 is a perspective view illustrating a cutting and conveying portion in the embodiment.

The cutting and conveying portion 640 has a movable abutting stopper 641 for regulating the leading edges of a third upper belt 645, a third lower belt 646, and the sheet bundle. The abutting stopper 641 can make frequent appearances on a conveyance passage and can also move in the sheet conveying direction. The cutting and conveying portion 640 sandwiches the sheet bundle delivered from the pinch belt conveying portion 620 between the third upper belt 645 and the third lower belt 646 to convey and abuts the leading edge of the sheet bundle against the stopper 641 so as to stop it in the abutted state. The cutting portion 630 stops the sheet bundle to cut the edges of the sheet bundle. Then, the cutting and conveying portion 640 conveys the sheet bundle to the vertical conveying portion 650. FIG. 4 is a perspective view of the cutting and conveying portion 640. FIG. 4 is a perspective view not showing the third upper belt 645 in order to give a simple illustration of the structure of the cutting and conveying portion 640 as well as the structure in the vicinity of the third lower belt 646 and the abutting stopper 641.

Further, the abutting stopper 641 disposed at the cutting and conveying portion 640 operates by being driven by a motor rotating on a K section via a cam 642 and the evacuating operation is carried out by making frequent appearances. The abutting stopper 641 is mounted on a slide block 643 and driven by a motor (not illustrated) along a slide guide 644 and then moves depending on the size in the conveying direction of the sheet bundle T or the stop position of the sheet bundle.

Figure 5:
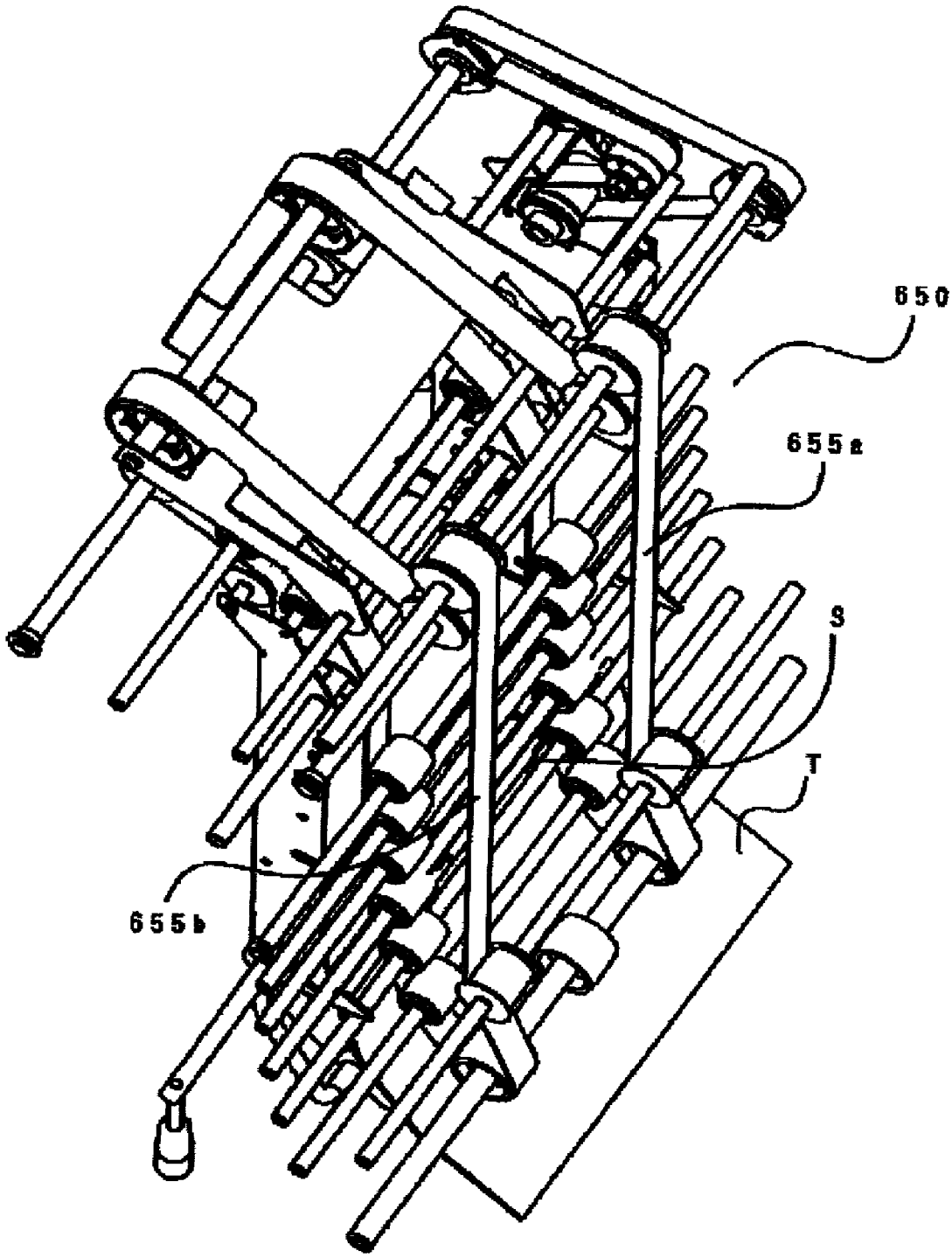
FIG. 5 is a perspective view illustrating a vertical conveying portion in the embodiment.

The vertical conveying portion 650 is a conveying portion that conveys the sheet bundle upward. The vertical conveying portion 650 conveys the sheet bundle by sandwiching the sheet bundle with a fourth lower belt 656 and fourth upper belts 655*a* and 655*b* (refer to FIG. 5).

As previously mentioned, the pinch belt conveying portion 620, the cutting and conveying portion 640, and the vertical conveying portion 650 are formed with a pair of conveying belts at the left and right sides or the top and bottom sides. The pair of belts sandwiches the sheet bundle for conveyance. At this time, in each of the conveying portions 620, 640, and 650, the rotation of the pair of conveying belts with a single motor enables the conveying speed of the pair of conveying belts to be synchronized.

In the cutting portion 630 that evenly cuts the edges of the sheet bundle and performs trimming, a cutter unit 631 is disposed at the position orthogonal to the conveying path. The cutter unit 631 is vertically moved in a direction perpendicular to the carrying path by being driven by a motor (not illustrated). A pressing member 632 and a cutter 633 are formed in the cutter unit 631 and the pressing member 632 abuts against the sheet bundle T before the vertical movement of the cutter unit 631. The pressing member 632 is energized downward by a spring member. The pressing member 632 is a member for evenly cutting the edges of the sheet bundle T in cooperation with the cutter 633 which follows the vertical movement of the cutter unit 631 while the pressing member 632 functions as a pinch conveying portion and sandwiches the sheet bundle T. In that case, by the cam member attached to the cutter unit 631, a shutter 625 disposed at the downstream side of the second conveying portion 630 opens and closes in conjunction with the vertical movement of the cutter unit 631. A scrap bin 635 is disposed on the lower side of the cutter unit 631 and stores scraps from the sheet bundle T cut by the cutter unit 631.

Further, the paper discharge portion 660 is disposed at the most downstream position and stacks the sheet bundle T conveyed from the vertical conveying portion 650.

The inserter 900 feeds the sheet set on the insert trays 901 and 902 by the user's selection to any of the sample tray 701, the stack tray 700, and the folded bundle discharge tray 850 without passing through the printer portion 300. The sheet bundle T stacked on the insert trays 901 and 902 is sequentially separated one by one and is joined to a finisher path 520 at the desired moment.

The trimmer unit 600 of the embodiment having the above-mentioned structure operates as follows. Hereinafter, the operation of the trimmer unit 600 will be described in line with the flow of the sheet bundle T.

The crease of the sheet bundle T bound with staples S is enhanced in the crease pressing unit 860 and then is reconveyed and transferred to the receiving and conveying portion 610 of the trimmer unit 600.

In the receiving and conveying portion 610, as illustrated in FIG. 3, the folded sheet bundle T is placed on the upper surface of the first conveying belts 611A and 611B that rotates to convey the sheet bundle T.

The outlet sensor (first sheet bundle detecting portion) 616 of the receiving and conveying portion 610 detects the conveyed sheet bundle T and stops the conveyance of the sheet bundle T temporarily by control of the finisher control portion 501 based on its detection signal. Then, the finisher control portion 501 controls the movement of the side guide 612 so that the width direction of the sheet bundle T is regulated and aligned by the side guide 612 disposed at the both sides of the carrying path. Subsequently, the conveying claw 613 at the upstream side of the receiving and conveying portion 610 starts pushing the sheet bundle T from behind and the finisher control portion 501 controls to restart the conveyance of the sheet bundle T. At this time, the first conveying belt 611 is in the stopped state. The reconveyed sheet bundle T is regulated in the width direction by the side guide 612. Further, the sheet bundle is upwardly pushed by pressing guides 614A and 614B as a regulating portion and thus regulated. The pressing guides 614A and 614B regulate the position of the sheet bundle in the thickness direction of the sheet bundle. While the space between the edges of the sheet bundle T is regulated in such a manner, it is conveyed while being pressed from above. The pressing guides 614A and 614B regulate the opening of the folded sheet bundle.

Figure 15A:
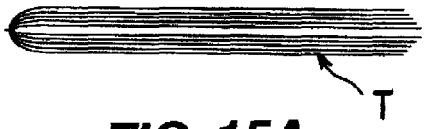
FIGS. 15A to 15E are views for illustrating problems associated with processing of the bundle of the sheets.
Figure 15D:
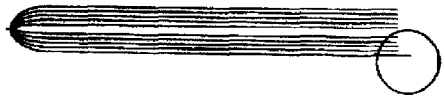
Figure 15B:
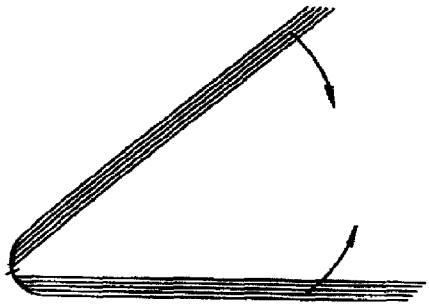
Figure 15E:
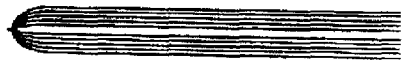
Figure 15C:
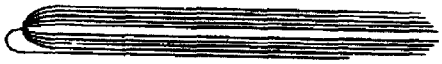

Although the sheet bundle T meets the resistance during the conveyance due to the regulation and pressing, the rear end of the sheet bundle is pushed from behind by the conveying claw 613. This pushing allows for avoiding the disadvantage that only the front cover sheet is precedently conveyed due to the coefficient of friction among the sheet bundle T, the first conveying belts 611A and 611B that support the sheet bundle T from below, and the pressing guide 614 and the coefficient of friction among the front cover sheet, the middle sheet, and the sheets of the sheet bundle T (refer to FIG. 15C). As a result, the conveyance of the sheet bundle T is ensured. Further, when the sheet bundle T is detected by the inlet sensor 623A of the pinch belt conveying portion 620 that is disposed at the downstream side of the nip J formed in the pinch belt conveying portion 620, the conveying claw 613 is evacuated to the conveying upstream side by the control based on its detection signal.

Figure 8:
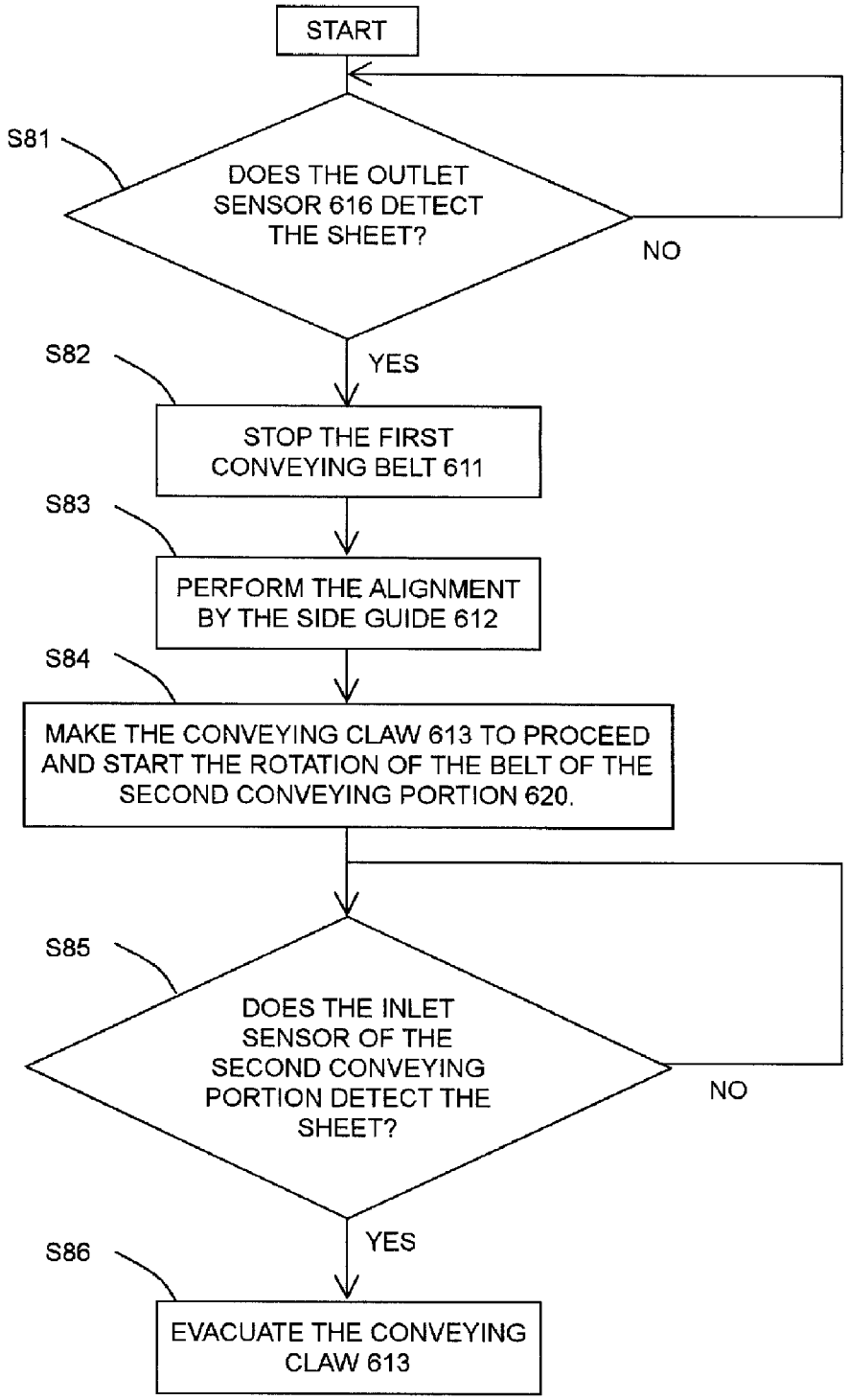
FIG. 8 is a flowchart illustrating the operation as a first embodiment.

FIG. 8 is a flow chart illustrating the above described series of operations in which the conveying claw 613 pushes the sheet bundle T to convey it after it is received and evacuates after finishing its operation.

That is, the finisher control portion 501 determines whether the outlet sensor 616 has detected the sheet bundle (S81) and controls to stop the rotation of the first conveying belt 611 when the outlet sensor 616 detects the sheet bundle (S82). Then, the finisher control portion 501 controls so that the side guide 612 performs the alignment (S83). When the alignment by the side guide 612 is finished, the finisher control portion 501 makes the conveying claw 613 to proceed and controls so as to start the rotation of the belt of the pinch belt conveying portion 620 (S84). Then, when the inlet sensor 623A of the pinch belt conveying portion 620 detects the sheet bundle (S85), the finisher control portion 501 controls so as to make the conveying claw 613 evacuate (S86). As described above, when the sheet bundle is conveyed by the conveying claw 613, the first conveying belt 611 remains stopped.

Then, the sheet bundle T passes through the cutting portion 630 from the pinch belt conveying portion 620 and is then conveyed to the cutting and conveying portion 640. In the cutting and conveying portion 640, the abutting stopper 641 appears on the carrying path in a proper position fitting to the size of the sheet bundle T in advance and is ready for abutting as shown in FIG. 4. When the sheet bundle T abuts against the abutting stopper 641, the skew feeding is corrected, thereby stopping the sheet bundle. Subsequently, the conveying belt 646 of the cutting and conveying portion 640 stops the rotating run and the cutter unit 631 of the cutting portion 630 starts the vertical movement. Then, the cutter 633 evenly cuts the edges of the sheet bundle T. Thereafter, the abutting stopper 641 evacuates and the conveyance of the cutting and conveying portion 640 is restarted. The sheet bundle T trimmed by cutting the edges thereof is transferred to the vertical conveying portion 650 located at the downstream side of the cutting and conveying portion 640. In the vertical conveying portion 650, the sheet bundle T is conveyed upward and discharged to a discharge tray portion 660, which is imbricately stacked in series.

Second Embodiment

Next, the structure and operation of the sheet post-processing apparatus in the present invention will be described. In the second embodiment, only different operations will be described in line with the flow of the sheet bundle T in the trimmer unit 600 illustrated in the first embodiment, and the overlapped description as to the common operation will not be repeated here. The movement of the conveying belts in the first embodiment is different from that in the second embodiment.

The crease of the sheet bundle T bound with staples S is enhanced in the crease pressing unit 860 and then is reconveyed and transferred to the receiving and conveying portion 610 of the trimmer unit 600. In the receiving and conveying portion 610, as illustrated in FIG. 3, the folded sheet bundle T is placed on the upper surface of the first conveying belts 611A and 611B that rotates to convey the sheet bundle T. The outlet sensor (first sheet bundle detecting portion) 616 of the receiving and conveying portion 610 detects the conveyed sheet bundle T and stops the conveyance of the sheet bundle T temporarily based on its detection signal. Then, the width direction of the sheet bundle T is regulated and aligned by the side guide 612 disposed at both sides of the carrying path. Subsequently, the conveying claw (conveyance supporting unit) 613 at the upstream side of the receiving and conveying portion 610 starts pushing the sheet bundle T from behind. In the embodiment, the conveyance of the sheet bundle T is restarted in cooperation with the first conveying belt 611.

That is, the second embodiment is different from the first embodiment in that the conveyance of the sheet bundle T is restarted in cooperation with the conveying claw 613 and the first conveying belt 611.

The sheet bundle T thus reconveyed is regulated in the width direction by the side guide 612 and aligned. Then, the sheet bundle T is conveyed while the edges thereof are pressed from above by the pressing guides 614A and 614B so as not to be misaligned. The sheet bundle T meets the resistance during the conveyance due to such a regulation and pressing.

Here, the pushing speed of the conveying claw 613 is set faster than the operating speed of the first conveying belt 611. Therefore, the sheet bundle T is mainly conveyed by the pushing of the conveying claw 613. As a result, the disadvantage that only the front cover sheet is precedently conveyed due to the coefficient of friction among the sheet bundle T, the first conveying belt 611, and the pressing guide 614 and the coefficient of friction among the front cover sheet, the middle sheet, and the sheets of the sheet bundle T (refer to FIG. 15C) is avoided and the conveyance of the sheet bundle T is ensured.

According to the second embodiment, the running speed of the first conveying belt 611 is slower than the operating speed of the conveying claw 613 due to the deceleration. Thus, the friction with the belt conveying surface is reduced and the rubbed stain is hardly caused. When the sheet bundle T is guide to the pinch belt conveying portion 620, it is mainly conveyed by the pushing of the conveying claw 613. Then, the inlet sensor 623A detects the sheet bundle T at the downstream side of the nip J of the pinch belt conveying portion 620. The operation that the conveying claw 613 evacuates to the upstream side based on the detection is performed in the same manner as described in the first embodiment.

Figure 9:
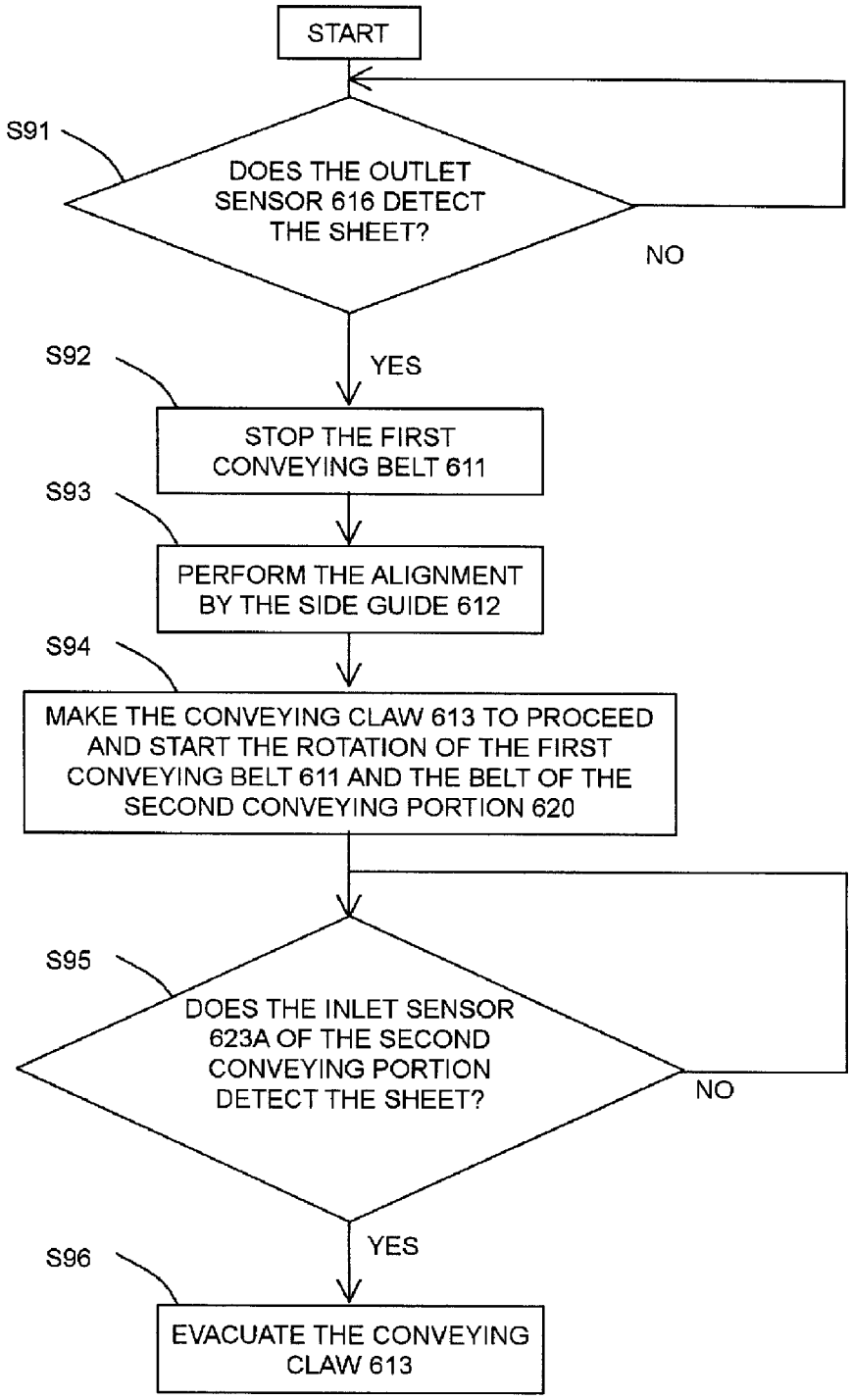
FIG. 9 is a flowchart illustrating the operation as a second embodiment.

FIG. 9 is a flow chart illustrating the series of operations in which the conveying claw 613 pushes the sheet bundle T to convey it after it is received and evacuates after finishing its operation. The step different from the first embodiment as illustrated in the flowchart of FIG. 8 involves a step of aligning the sheet bundle in the width direction by the side guide 612 and then stopping the rotation of the first conveying belt 611, and other steps are the same as that shown in FIG. 8.

That is, the finisher control portion 501 determines whether the outlet sensor 616 has detected the sheet bundle (S91) and controls to stop the rotation of the first conveying belt 611 when the outlet sensor 616 detects the sheet bundle (S91). Then, the finisher control portion 501 controls so that the side guide 612 performs the alignment (S93). When the alignment by the side guide 612 is finished, the finisher control portion 501 makes the conveying claw 613 to proceed and controls so as to start the rotation of the first conveying belt 611 and the belt of the pinch belt conveying portion 620 (S94). At this time, the peripheral speed of conveying belt is lower than the traveling speed of the conveying claw 613. Then, when the inlet sensor 623A of the pinch belt conveying portion 620 detects the sheet bundle (S95), the finisher control portion 501 controls so as to make the conveying claw 613 evacuate (S96). As described above, when the sheet bundle is conveyed by the conveying claw 613, the first conveying belt 611 is also rotating. However, the conveying speed of the first conveying belt 611 is set to a lower speed than the conveying speed of the conveying claw 613.

Third Embodiment

Next, the structure and operation of the third embodiment in the present invention will be described.

Figure 10:
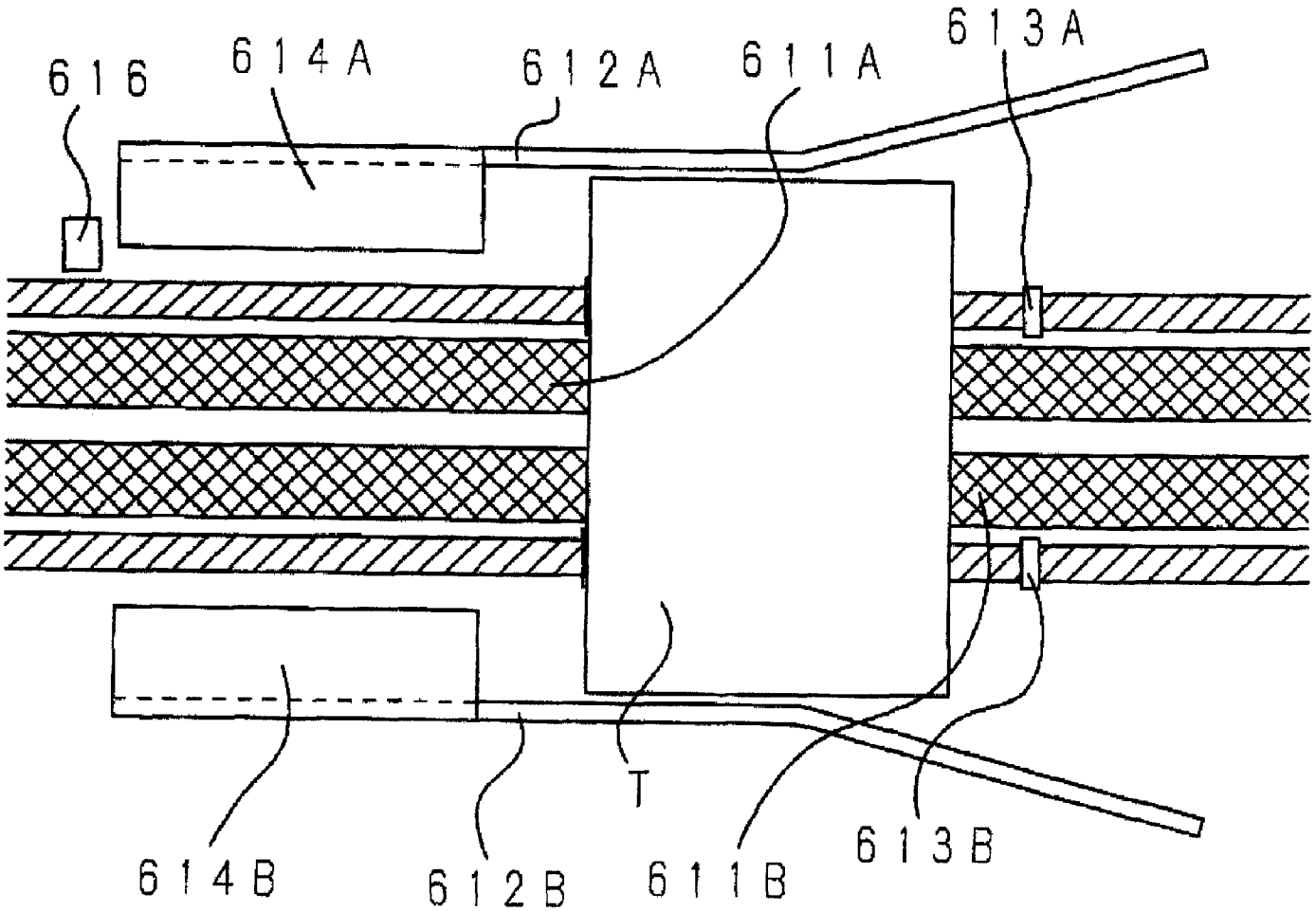
FIG. 10 is a plain view illustrating the shape of the side-guide of the third embodiment as an application example of the receiving and conveying portion in the first embodiment.

As illustrated in FIG. 10, in the third embodiment, it is a key point that the shape of the side guides 612A and 612B is formed so that both guides are extended and opened in the width direction of the sheet bundle at the upstream sides of the conveying direction. In other words, the side guide 612 is formed in the same size as the width of the sheet bundle T at the downstream side of the conveying direction, which allows the sheet bundle T to align automatically during the conveyance even if the alignment is not performed.

Therefore, the trimmer unit 600 operates in the same manner as described in the first and second embodiments until the inlet sensor 623A detects the sheet bundle T at the downstream side of the nip J of the pinch belt conveying portion 620 and then the conveying claw 613 is evacuated to the conveying upstream side.

Figure 11:
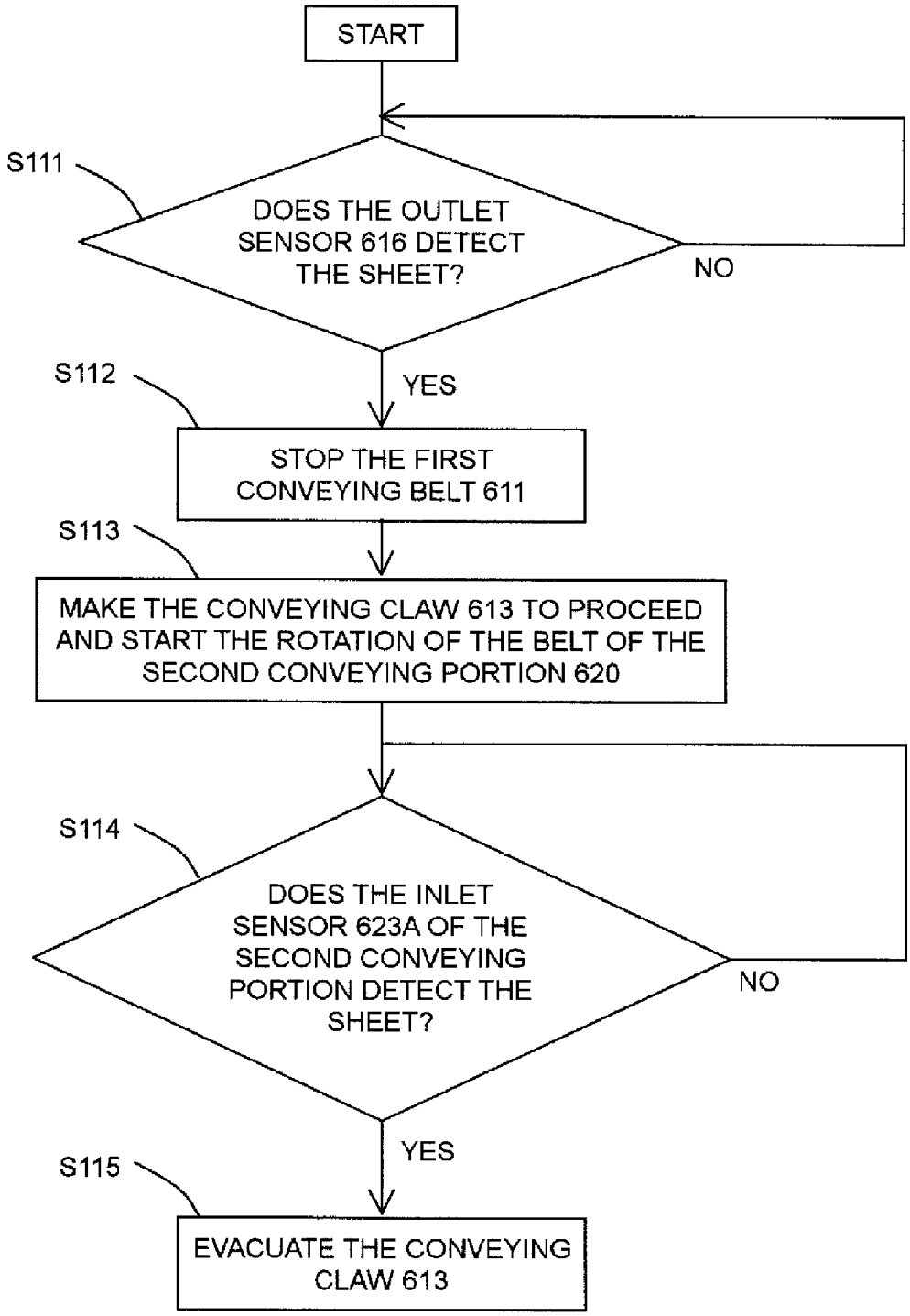
FIG. 11 is a flowchart illustrating the operation as a third embodiment.

In that case, as illustrated in the operation flow chart of FIG. 11, when the outlet sensor 616 of the receiving and conveying portion 610 detects the sheet bundle T, the rotating run of the first conveying belt 611 is stopped. The following steps are the same as each step of the operation flow chart of FIG. 8.

That is, the finisher control portion 501 determines whether the outlet sensor 616 has detected the sheet bundle (S111) and controls to stop the rotation of the first conveying belt 611 when the outlet sensor 616 detects the sheet bundle (S112). Thereafter, the finisher control portion 501 makes the conveying claw 613 to proceed and controls so as to start the rotation of the belt of the pinch belt conveying portion 620 (S113). Then, when the inlet sensor 623A of the pinch belt conveying portion 620 detects the sheet bundle (S114), the finisher control portion 501 controls so as to make the conveying claw 613 evacuate (S115). As described above, when the sheet bundle is conveyed by the conveying claw 613, the first conveying belt 611 remains stopped.

Figure 12:
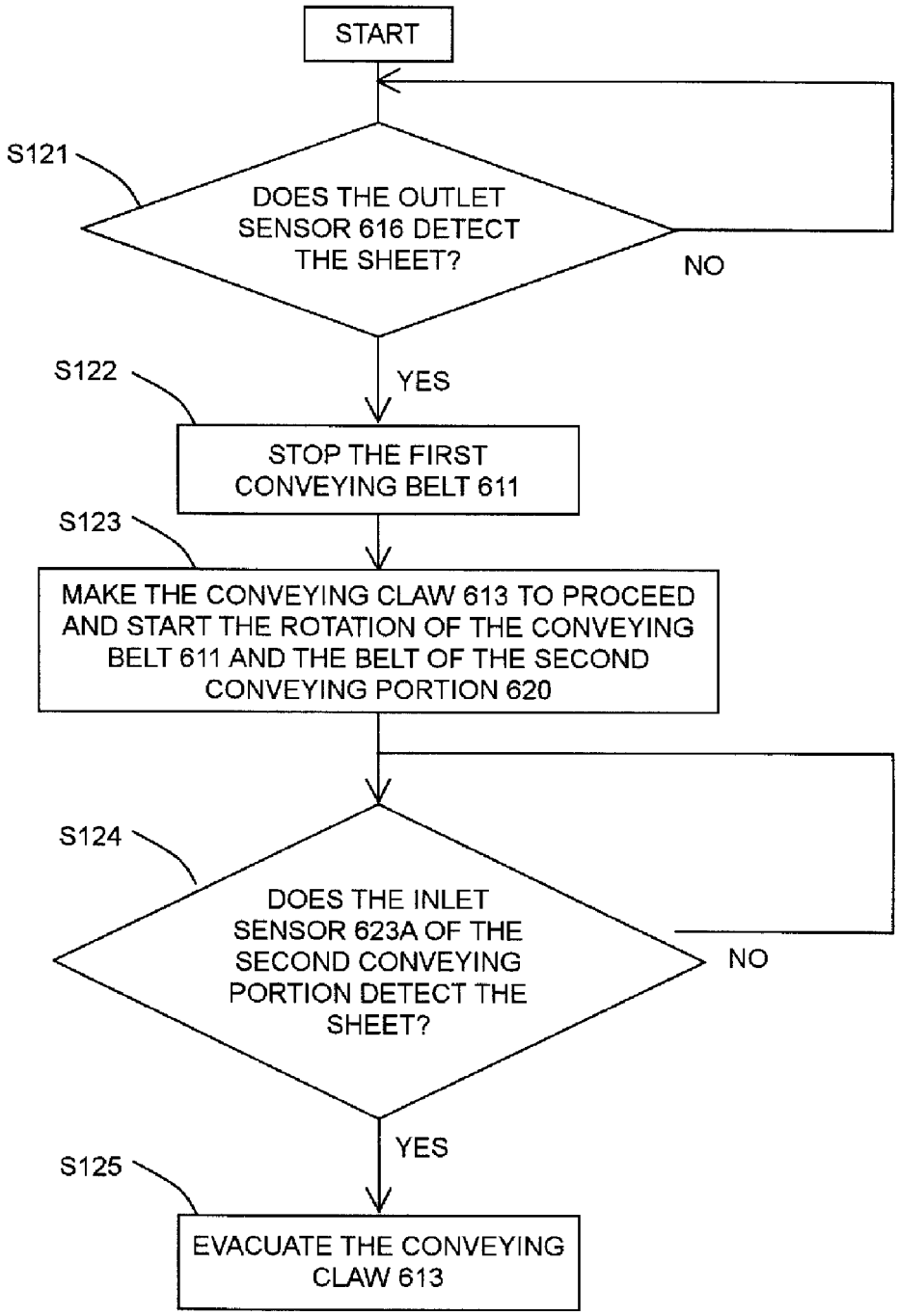
FIG. 12 is an operation flowchart illustrating as a first modification of the third embodiment.
Figure 13:
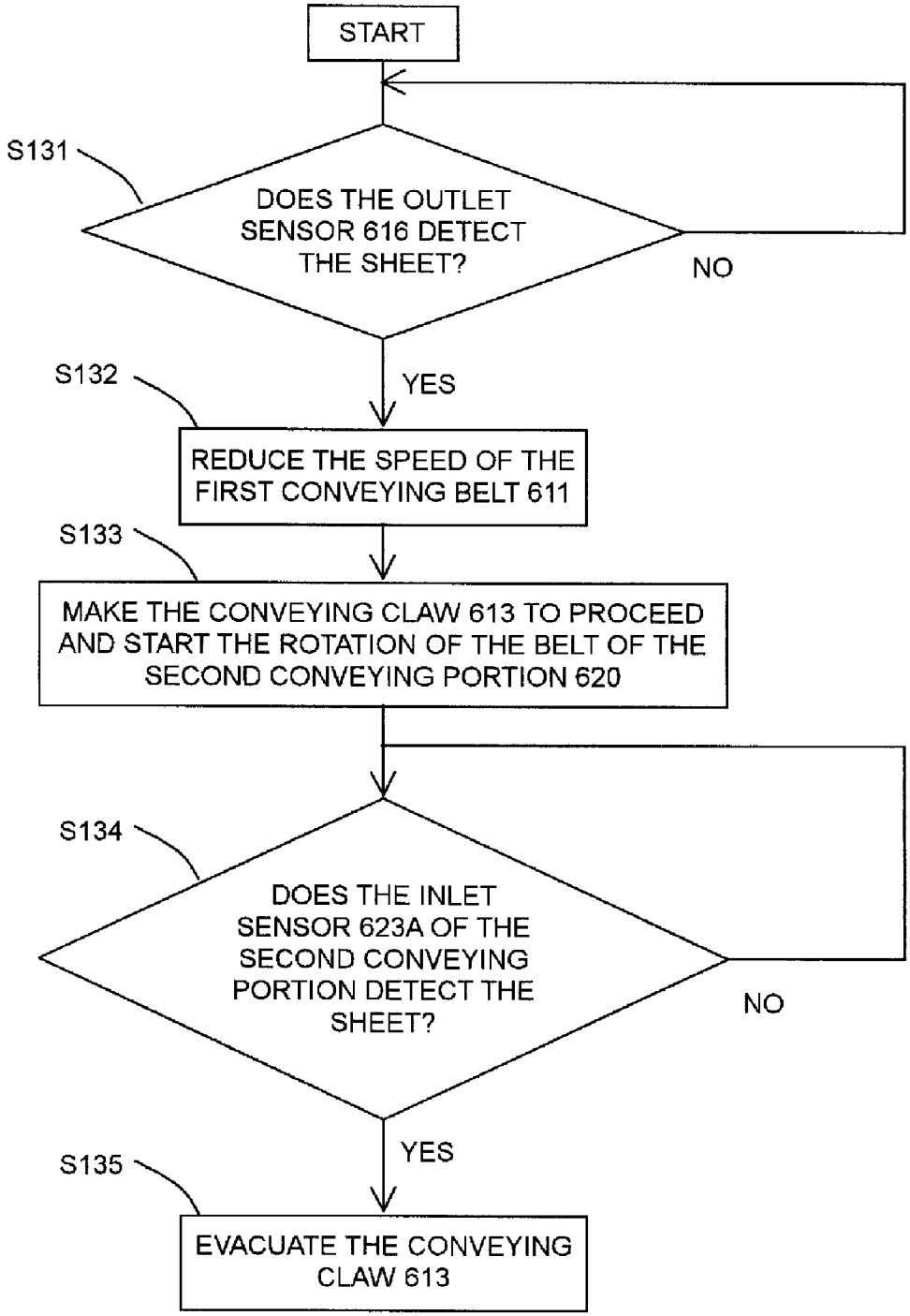
FIG. 13 is an operation flowchart similarly illustrating as the first modification of the third embodiment.
Figure 14:
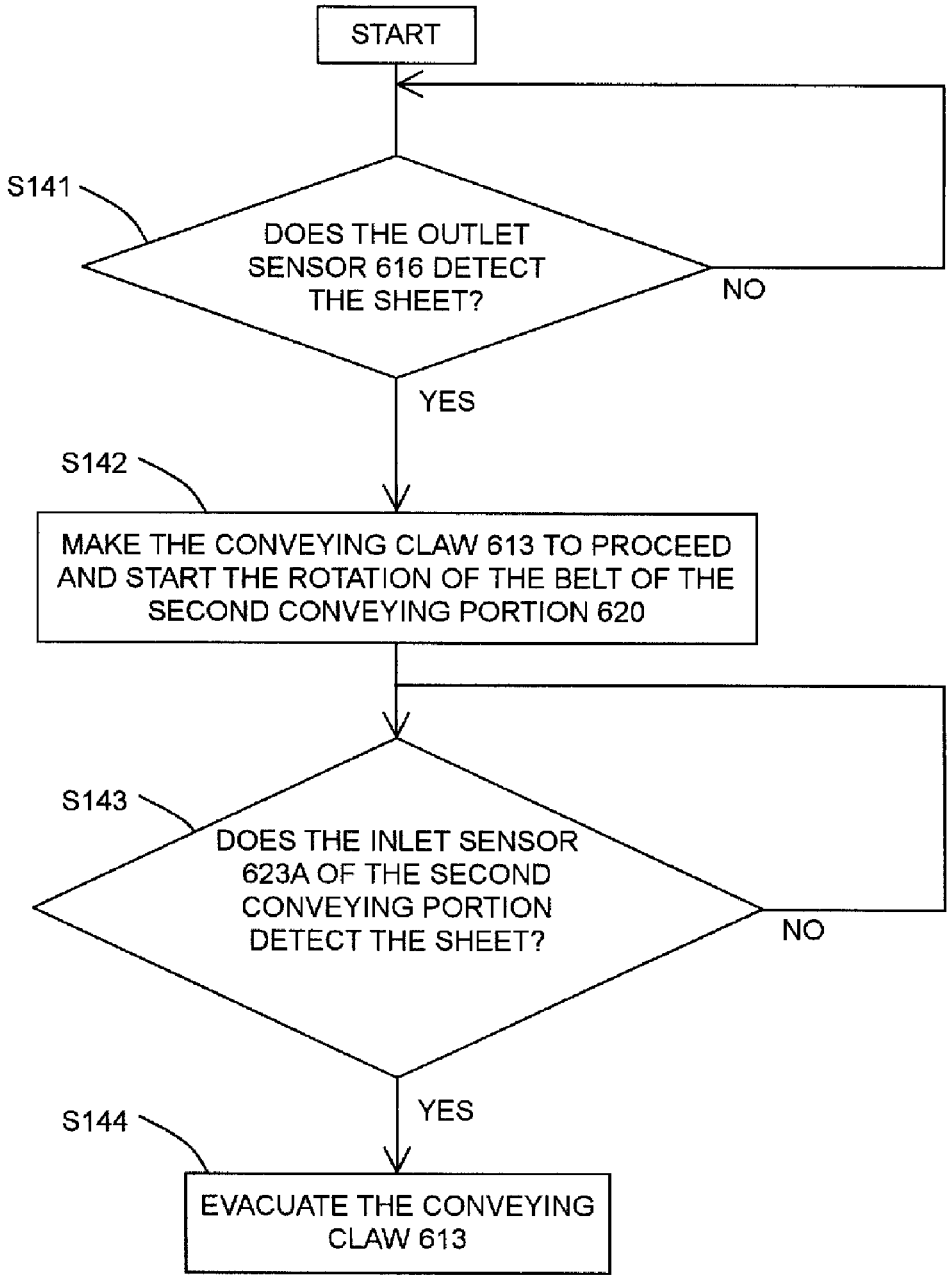
FIG. 14 is an operation a flowchart similarly illustrating the first modification of the third embodiment.

Further, even when a modification based on the flowcharts of FIGS. 12 to 14 is operated, the same effect can be produced. In this case, the running speed of the first conveying belt 611 after the outlet sensor 616 of the receiving and conveying portion has detected the sheet is set to a lower speed than the operating speed of the conveying claw 613 and the sheet bundle T is conveyed.

In the first modification illustrated in FIG. 12, the operation of the conveying belt 611 is stopped based on the detection signal from the outlet sensor 616 and then the conveying belt 611 is made to operate again and the sheet bundle is conveyed by the first conveying belt 611 and the conveying claw 613 that operates at the speed higher than the operating speed of the first conveying belt 611.

That is, the finisher control portion 501 determines whether the outlet sensor 616 has detected the sheet bundle (S121) and controls to stop the rotation of the first conveying belt 611 when the outlet sensor 616 detects the sheet bundle (S122). Thereafter, the finisher control portion 501 makes the conveying claw 613 to proceed and controls so as to start the rotation of the first conveying belt 611 and the belt of the pinch belt conveying portion 620 (S123). At this time, the peripheral speed of conveying belt is lower than the traveling speed of the conveying claw 613. Then, when the inlet sensor 623A of the pinch belt conveying portion 620 detects the sheet bundle (S124), the finisher control portion 501 controls so as to make the conveying claw 613 evacuate (S125). As described above, when the sheet bundle is conveyed by the conveying claw 613, the first conveying belt 611 is also rotating. However, the conveying speed of the first conveying belt 611 is set to a lower speed than the conveying speed of the conveying claw 613.

In the second modification illustrated in FIG. 13, the conveying claw 613 starts the operation based on the detection signal from the outlet sensor 616 and the speed of the first conveying belt 611 is reduced so that it is lower than the speed of the conveying claw 613 that has started the operation, and then the sheet bundle is conveyed by the conveying claw 613 and the first conveying belt 611.

That is, the finisher control portion 501 determines whether the outlet sensor 616 has detected the sheet bundle (S131). When the outlet sensor 616 detects the sheet bundle, the finisher control portion 501 controls so as to reduce the rotating speed of the first conveying belt 611 (S132). Thereafter, the finisher control portion 501 makes the conveying claw 613 to proceed and controls so as to start the rotation of the belt of the pinch belt conveying portion 620 (S133). At this time, the peripheral speed of the first conveying belt 611 is reduced, and therefore it is lower than the traveling speed of the conveying claw 613. Then, when the inlet sensor 623A of the pinch belt conveying portion 620 detects the sheet bundle (S134), the finisher control portion 501 controls so as to make the conveying claw 613 evacuate (S135). As described above, when the sheet bundle is conveyed by the conveying claw 613, the first conveying belt 611 is also rotating. However, the conveying speed of the first conveying belt 611 is set to a lower speed than the conveying speed of the conveying claw 613.

In the third modification illustrated in FIG. 14, the conveying claw 613 starts the operation based on the detection signal from the outlet sensor 616. The first conveying belt 611 continues to convey the sheet regardless of the detection signal from the outlet sensor 616.

That is, in the third modification illustrated in FIG. 14, the conveying claw 613 starts the operation based on the detection signal from the outlet sensor 616 and the speed of the first conveying belt 611 is increased so that it is higher than the speed of the conveying claw 613 that has started the operation, and then the sheet bundle is conveyed by the conveying claw 613 and the first conveying belt 611.

That is, the finisher control portion 501 determines whether the outlet sensor 616 has detected the sheet bundle (S141). When the outlet sensor 616 detects the sheet bundle, the finisher control portion 501 makes the conveying claw 613 to proceed and controls so as to start the rotation of the belt of the pinch belt conveying portion 620 (S142). At this time, the first conveying belt 611 continues to rotate; however, the peripheral speed of conveying belt is lower than the traveling speed of the conveying claw 613. Then, when the inlet sensor 623A of the pinch belt conveying portion 620 detects the sheet bundle (S143), the finisher control portion 501 controls so as to make the conveying claw 613 evacuate (S144). As described above, when the sheet bundle is conveyed by the conveying claw 613, the first conveying belt 611 is also rotating. However, the conveying speed of the first conveying belt 611 is set to a lower speed than the conveying speed of the conveying claw 613.

In any of the embodiments of the present invention, when the sheet bundle is pressed down by the pressing guides 614A and 614B so that a space between the edges of the sheet bundle is not opened, the conveying claw 613 operates at the speed higher than the operating speed of the first conveying belt 611. As a result, such a structure is effective in reducing the friction with the belt conveying surface and avoiding the rubbed stain.

That is, the rear end of the sheet bundle pressed down by the pressing guides 614A and 614B is pushed by the conveying claw 613 that operates at the speed higher than the operating speed of the first conveying belt 611, thereby ensuring a reliable conveyance of the sheet avoiding the rubbed stain caused by the friction with the belt conveying surface. Here, it is not always necessary that the conveying claw 613 supports the conveyance of the sheet bundle continually while the sheet bundle abuts against the pressing guides 614A and 614B. As described in the embodiments, the conveying claw 613 pushes the rear end of the sheet bundle in the timing when the friction between the belt conveying surface and the sheet bundle has an adverse effect while the sheet bundle abuts against the pressing guides 614A and 614B.

The exemplary embodiments of the sheet post-processing apparatus according to the present invention have been described hereinabove, but they are not to be construed as being limited thereto. Other embodiments, modifications, variations, and combinations thereof can be made without departing from the spirit and scope of the invention.

In addition, in above mentioned embodiments, it is described that the first conveying belt 611, that is provided to support a sheet bundle at a location to face the pressing guides 614A, 614B. However, it can be formed that the support guide (an supporter) configured to support a sheet bundle is provided at a location to face the pressing guide 614A, 614B, instead of the first conveying belt 611. In this case the support guide is fixed. The conveying claw 613 moves relative to a support guide to convey a sheet bundle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-021282, filed Jan. 31, 2007, which is hereby incorporated by reference herein in its entirety.

What is claimed is:

1. A conveying apparatus, comprising:

a regulating portion configured to regulate an opening of a folded sheet bundle conveyed in a conveying direction;

a conveying belt configured to convey the folded sheet bundle placed thereon in the conveying direction toward the regulating portion in the state that a folded portion of the folded sheet bundle is located at a downstream end in the conveying direction;

a conveying portion configured to convey the folded sheet bundle by pushing a rear end of the folded sheet bundle from an upstream side in the conveying direction; and a pinch conveying portion which pinches and conveys the folded sheet bundle and is disposed downstream of the regulating portion in the conveying direction, wherein the regulating portion is provided above the conveying belt, and wherein the conveying portion pushes the rear end of the folded sheet bundle on the driven conveying belt at a conveying speed that is higher than a conveying speed of the driven conveying belt or the rear end of the folded sheet bundle on the stopped conveying belt, in the state that the opening of the folded sheet bundle is regulated by the regulating portion, so that the pinch conveying portion pinches the downstream end of the folded sheet bundled.

2. The conveying apparatus according to claim 1, further comprising:

a sheet bundle detecting portion configured to detect the folded sheet bundle conveyed by the conveying belt; and a control portion configured to stops the operation of the conveying belt based on a detection signal from the sheet bundle detecting portion that has detected the folded sheet bundle being conveyed by the conveying belt and makes the conveying portion to operate so that the conveying portion conveys the folded sheet bundle in a state that the conveying belt is stopped.

3. The conveying apparatus according to claim 2, further comprising:

an aligning portion configured to align the folded sheet bundle conveyed by the conveying belt in a direction perpendicular to the sheet conveying direction, wherein the control portion controls so as to stop the operation of the conveying belt based on the detection signal from the sheet bundle detecting portion that has detected the folded sheet bundle conveyed by the conveying belt, and then make the aligning portion to operate in order to align the folded sheet bundle.

4. The conveying apparatus according to claim 1, further comprising:

a sheet bundle detecting portion configured to detect the folded sheet bundle conveyed by the conveying belt; and a control portion which controls so as to make the conveying portion start operating to convey the folded sheet bundle based on the detection signal from the sheet bundle detecting portion that has detected the folded sheet bundle conveyed by the conveying belt.

5. The conveying apparatus according to claim 4, wherein the control portion controls the speed of the conveying belt so as to be lower than the speed of the conveying portion that has started the operation based on the detection signal from the sheet bundle detecting portion.

6. The conveying apparatus according to claim 1, further comprising:

an aligning portion configured to align the folded sheet bundle in a direction perpendicular to the conveying direction;

a sheet bundle detecting portion configured to detect the folded sheet bundle conveyed; and a control portion which controls so as to stop the operation of the conveying belt based on the detection signal from the sheet bundle detecting portion that has detected the folded sheet bundle conveyed by the conveying belt, make the aligning portion to operate in order to align the folded sheet bundle, and then make the conveying belt and the conveying portion convey the folded sheet bundle, wherein the conveying speed of the conveying portion is set at the speed higher than the conveying speed of the conveying belt when the folded sheet bundle is conveyed by the conveying belt and the conveying portion.

7. A post-processing apparatus, comprising:

a folding unit configured to fold a sheet bundle; and a conveying apparatus according to claim 1, wherein the conveying apparatus conveys the sheet bundle which as been folded by the folding unit.

8. The post-processing apparatus according to claim 7, further comprising:

a cutting portion configured to cut the edge of the folded sheet bundle which has been conveyed by the pinch conveying portion of the conveying apparatus.

9. The post-processing apparatus according to claim 8 further comprising, a discharge unit configured to discharge the folded sheet bundle on the conveying belt.

10. An image forming apparatus comprising:

an image forming unit configured to form an image on a sheet and a post-processing apparatus according to claim 7, wherein the post-processing apparatus processes the sheet on which an image is formed by the image forming unit.

* * * * *